US007559493B1

(12) United States Patent
Hockmeyer et al.

(10) Patent No.: US 7,559,493 B1
(45) Date of Patent: Jul. 14, 2009

(54) DETERRING WEAR AT A BEARING CONSTRUCT IN A BASKET MEDIA MILL

(75) Inventors: Herman H. Hockmeyer, Saddle River, NJ (US); Barry W. Cullens, Elizabeth City, NC (US)

(73) Assignee: Hockmeyer Equipment Corp., Harrison, NJ (US)

( * ) Notice: Subject to any disclaimer, the term of this patent is extended or adjusted under 35 U.S.C. 154(b) by 138 days.

(21) Appl. No.: 11/845,421

(22) Filed: Aug. 27, 2007

(51) Int. Cl.
*B02C 17/02* (2006.01)

(52) U.S. Cl. ..... 241/21; 241/74; 241/171; 241/172

(58) Field of Classification Search ..... 241/21, 241/30, 171, 172, 74
See application file for complete search history.

(56) References Cited

U.S. PATENT DOCUMENTS 3,327,953 A * 6/1967 Krumholz, Sr. ..... 241/98
4,620,673 A 11/1986 Canepa et al.
5,184,783 A 2/1993 Hockmeyer et al.
5,497,948 A 3/1996 Hockmeyer
5,820,040 A 10/1998 Hockmeyer et al.
7,175,118 B2 2/2007 Hockmeyer et al.
2004/0021021 A1* 2/2004 Ishikawa ..... 241/172
2005/0258288 A1* 11/2005 Dalziel et al. ..... 241/172

* cited by examiner

*Primary Examiner*—Mark Rosenbaum
(74) *Attorney, Agent, or Firm*—Arthur Jacob

(57) ABSTRACT

A media basket mill utilizes a media bed having very small media to attain a mixture of finely divided solids in a liquid vehicle. A bearing construct which journals the rotor of the basket mill within the basket of the mill includes a bearing which is protected against excessive wear by including a recess in the rotor. The recess is juxtaposed with the bearing and communicates with the media bed such that upon rotation of the rotor to pass feedstock through the media bed for a mixing operation, media and feedstock in the vicinity of the bearing will be directed from the recess into the bed of media and feedstock outside the rotor, thereby diverting media and feedstock away from the bearing and deterring excessive wear which might otherwise result from media and feedstock interacting with the bearing during rotation of the rotor for the mixing operation.

17 Claims, 3 Drawing Sheets

DETERRING WEAR AT A BEARING CONSTRUCT IN A BASKET MEDIA MILL

The present invention relates generally to the dispersion of selected constituents into liquids through the utilization of a basket media mill in which solid constituents are finely divided and dispersed into a liquid vehicle, as in the manufacture of paints, coatings, inks and like products, and pertains, more specifically, to improvements in a basket media mill and method for deterring wear which otherwise might occur as a result of deleterious interaction of grinding media and feedstock within the basket of the mill with a basket bearing construct exposed to the media and the feedstock during mixing operations.

An increasing demand for mixtures containing dispersions of very finely divided solids, such as inks utilized in ink-jet printers, and paints and other coatings exhibiting more well-defined colors in thinner layers, has given rise to a requirement for processing equipment and techniques which can produce the desired mixtures with greater ease, efficiency and economy. In an earlier patent, U.S. Pat. No. 5,184,783, the disclosure of which is incorporated herein by reference thereto, there is described a basket media mill of the type in which a basket containing a bed of grinding media is immersed within a mixture of liquid and solids to be dispersed in the liquid, held within a vessel, and the mixture is moved through the basket, and through the bed of media in the basket, to circulate the mixture in the vessel and divide and disperse the solids within the liquid vehicle. While such basket media mills have proved to be highly effective in quickly processing mixtures of liquid with dispersions of solids, the demand for still finer dispersions has dictated the use of smaller grinding media; however, it has been observed that as the size of the grinding media is decreased, the danger of excessive wear at the basket bearing construct of the basket media mill is increased due to deleterious interaction between the bearing construct and the grinding media, as well as the feedstock which carries fine dispersions of solids, which can enter the bearing construct and, through aggressive abrasion, can cause excessive wear and early failure of the bearing construct. Attempts at sealing the bearing construct against exposure to the grinding media and feedstock have met with little success since the highly abrasive nature of the grinding media and the feedstock soon wears away the sealing structure, enabling the grinding media and the feedstock to attack the bearing construct itself.

The present invention deters wear at the basket bearing construct of a basket media mill by diverting the grinding media and the feedstock present in the basket of the mill away from the basket bearing construct during processing of a mixture within the mill, thereby avoiding deleterious interaction between the bearing construct and the media, as well as the feedstock, and protecting against excessive wear of the bearing construct. As such, the present invention attains several objects and advantages, some of which are summarized as follows: Enables the processing of mixtures containing more finely divided solids within a basket media mill without encountering excessive wear at the basket bearing construct of the mill; renders practical the use of basket media mills in the processing of mixtures which require much finer dispersions of solids in a liquid vehicle, with the concomitant benefits of greatly reduced processing time and increased efficiency; eliminates the need for elaborate sealing structures and the like in protecting against excessive wear at the basket bearing construct of a basket media mill, especially during the processing of mixtures containing finer dispersions of solids; enables the use of much smaller media in a basket media mill for accomplishing much finer dividing and dispersion of solids into a liquid vehicle; greatly increases the effective service life of a basket media mill, and especially a mill utilized for processing mixtures containing very finely divided solids, by deterring wear at the basket bearing construct of the apparatus.

The above objects and advantages, as well as further objects and advantages, are attained by the present invention which may be described briefly as an improvement in a media basket mill having a basket with a basket wall establishing an interior for containing a bed of very small media within the basket, and a rotor having a hub journaled within a basket bearing construct for rotation about an axial direction within the basket while feedstock is passed through the basket, the improvement comprising: a recess within the hub of the rotor, the recess being juxtaposed with the bearing construct and extending in the axial direction away from the bearing construct and into the hub, and in radial directions to expose the bearing construct to the recess and to establish a hub wall between the recess and the interior of the basket; and at least one opening in the hub, the opening extending through the hub wall in a radial direction from the recess to the interior of the basket outside the rotor such that upon rotation of the rotor, media and feedstock in the vicinity of the bearing construct will be directed from the recess through the opening to the interior of the basket and into the bed of media and feedstock outside the rotor, thereby diverting media and feedstock away from the bearing construct and deterring excessive wear which might otherwise result from media and feedstock interacting with the bearing construct during rotation of the rotor.

In addition, the invention provides a method for deterring wear at a basket bearing construct in a media basket mill having a basket with a basket wall establishing an interior for containing a bed of very small media within the basket, and a rotor having a hub journaled within the basket bearing construct for rotation about an axial direction within the basket while feedstock is passed through the basket, the method comprising: providing a recess within the hub of the rotor; placing the recess in juxtaposition with the bearing construct so as to extend in the axial direction away from the bearing construct and into the hub, and in radial directions to expose the bearing construct to the recess and to establish a hub wall between the recess and the interior of the basket; providing at least one opening in the hub; placing the opening so as to extend through the hub wall in a radial direction from the recess to the interior of the basket outside the rotor; and rotating the rotor to direct media and feedstock in the vicinity of the bearing construct from the recess through the opening to the interior of the basket and into the bed of media and feedstock outside the rotor, to thereby divert media and feedstock away from the bearing construct and deter excessive wear at the bearing construct which might otherwise result from media and feedstock interacting with the bearing construct during rotation of the rotor.

The invention will be understood more fully, while still further objects and advantages will become apparent, in the following detailed description of preferred embodiments of the invention illustrated in the accompanying drawing, in which.

Figure 1:
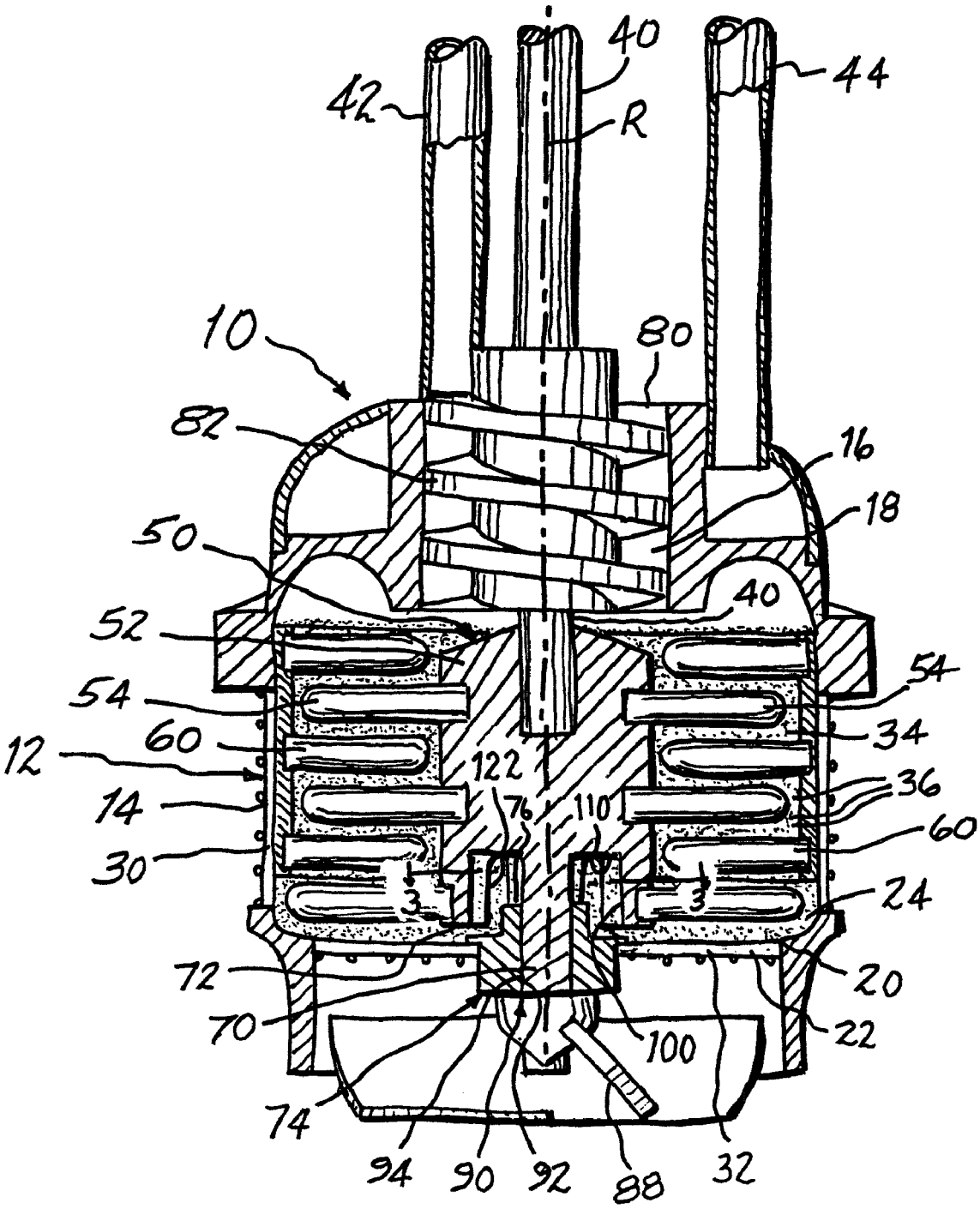
FIG. 1 is a somewhat diagrammatic longitudinal cross-sectional view of a basket media mill constructed in accordance with the present invention.
Figure 2:
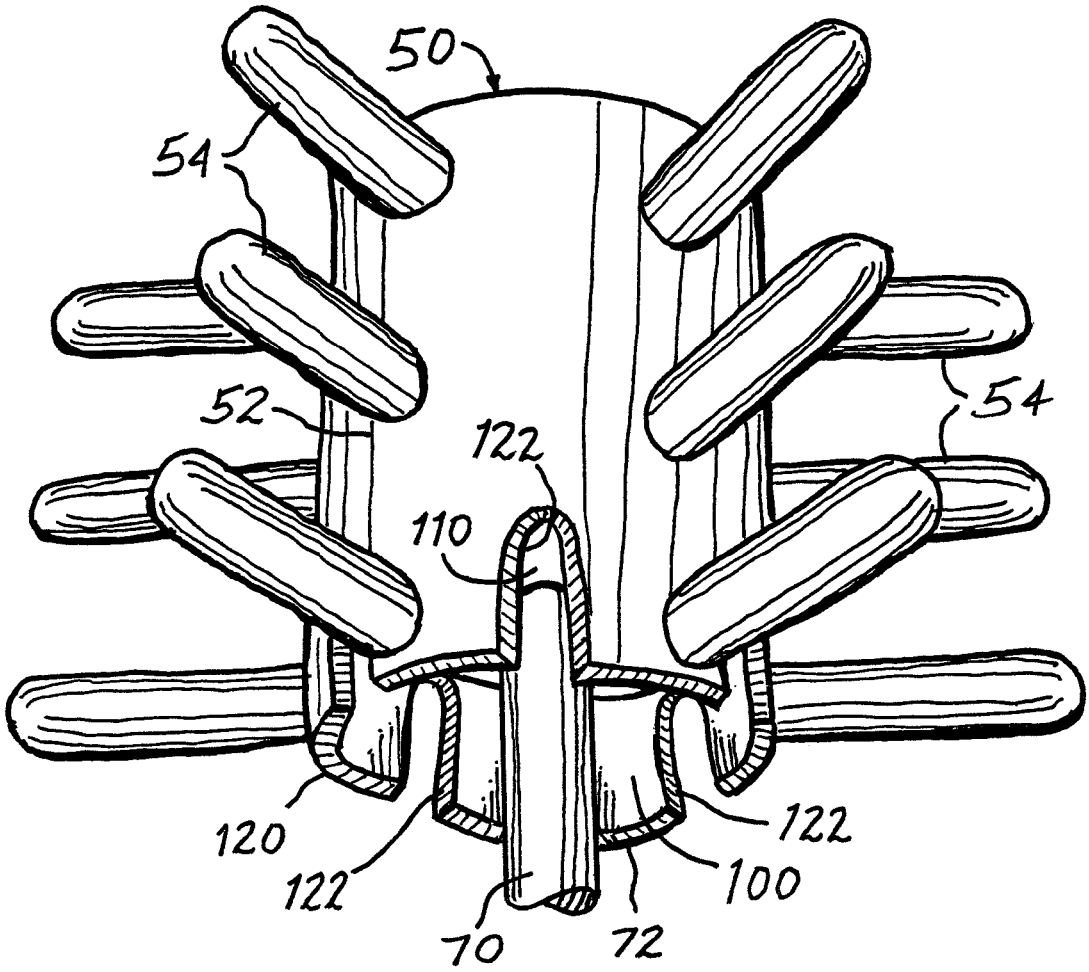
FIG. 2 is a terminal end and side perspective view of the rotor of the basket media mill.

Referring now to the drawing, and especially to FIGS. 1 and 2 thereof, a basket media mill constructed in accordance with the present invention is illustrated at 10 and is seen to include a basket 12 which is to be selectively inserted into a vessel (not shown), as described in the aforesaid U.S. Pat. No. 5,184,783, so as to be immersed in the contents of the vessel. Basket 12 has a generally cylindrical configuration and includes a cylindrical side wall 14 extending axially from an entrance 16, at upper end 18, vertically downwardly to a lower end 20. A bottom wall 22 spans the lower end 20 of the basket 12 and completes the interior 24 of the basket 12. The cylindrical side wall 14 of the basket 12 is constructed of a grid-like material having openings shown in the form of slots 30 passing radially through the side wall 14. Similar openings in the form of further slots 32 extend axially through the bottom wall 22.

A media bed 34 is placed within the interior 24 of the basket 12 and is shown as a mass of grinding media comprised of discrete media elements illustrated in the form of beads 36. The relative dimensions of the beads 36 and the slots 30 and 32 are such that the media bed 34 is retained within the interior 24 of basket 12. That is, the lateral width of the slots 30 and 32 is no greater than the minimum diameter of the beads 36 so as to facilitate the flow of the contents of the vessel, referred to as feedstock, through the basket 12 while preventing the escape of beads 36 from the basket 12.

A drive shaft 40 extends axially into the basket 12 and is journaled for rotation relative to the basket 12, about an axis of rotation R. Columns 42 and 44 support the basket 12 and mount the basket 12 in a secure; fixed position within the vessel. A rotor 50 is coupled to the drive shaft 40 and includes a hub 52 which carries a plurality of stirring rods 54 extending radially outwardly from the hub 52, toward the side wall 14 of the basket 12, the stirring rods 54 being placed axially along the hub 52 and arrayed circumferentially around the hub 52. Upon rotation of the drive shaft 40 and the hub 52, the stirring rods 54 will cause the beads 36 to move with a random up and down motion, rather than moving as a mass only in a rotational motion, and a desired shearing or grinding action is attained so as to divide solid material carried by the feedstock and disperse the divided solid material into, and mix the dispersed solid material with, the liquid vehicle of the feedstock. Any tendency toward packing of the of the media bed 34 or clogging of the slots 30 and 32 is reduced by the movement of the stirring rods 54. Generally, approximately ninety percent of the mixing accomplished within the basket media mill 10 takes place within the basket 12. A plurality of static rods 60 are affixed to the side wall 14 of the basket 12 so as to be stationary relative to the rotating stirring rods 54. The static rods 60 are juxtaposed with counterpart stirring rods 54 for interacting with the counterpart stirring rods 54 to attain combined attrition and rolling shear within the media bed 34, the static rods 60 extending radially inwardly from the side wall 14 of the basket 12, toward the hub 52 of rotor 50, axially adjacent counterpart stirring rods 54, so as to tend to stabilize the media bed 34 in radial directions while increasing the combined attrition and rolling shear attained between the static rods 60 and the counterpart stirring rods 54.

Rotor 50 is journaled for rotation within basket 12 about axis of rotation R and includes a shaft 70 depending from the terminal end 72 of hub 52 of the rotor 50 and extending axially into, and preferably through, a basket bearing construct which includes a bearing shown in the form of a bushing 74 secured to the bottom wall 22 of the basket 12. Bushing 74 extends axially upwardly into the interior 24 of the basket 12 and terminates at an upper end 76. Upon rotation of the drive shaft 40, feedstock is fed into basket 12 through a tubular inlet passage 80 located at entrance 16, assisted by an upper impeller, shown in the form of helical screw impeller 82 coupled with the drive shaft 40. A pressure differential established between the upper impeller and a lower impeller, illustrated in the form of impeller 88, moves the feedstock through the basket 12, and through the media bed 34 within the interior 24 of the basket 12. At the same time, the rotor 50 is rotated to move the stirring rods 54 through the media bed 34.

Heretofore, the size of the media in the media bed 34, that is, the size of the beads 36 of the illustrated embodiment, has been limited to a range extending down to a minimum size of about 0.5 millimeter. The size of the divided solids dispersed into the liquid vehicle of a mixture being processed in a basket media mill is related directly to the size of the media in the media bed. Thus, in order to meet the requirements for dividing solids into very fine solid constituents and dispersing the fine solid constituents into the liquid vehicle to process a mixture of very fine solid constituents within the liquid vehicle, it becomes necessary to reduce the size of the media itself. However, it has been observed that by reducing the size of the media below about 0.5 millimeter, and preferably within a range reaching below 0.5 millimeter and down to about 0.05 millimeter, the media becomes small enough to attack and abrade the basket bearing construct, which ordinarily is exposed to the media in the media bed, leading to excessive wear and early failure of the bearing construct, and a concomitant shortened service life of the basket media mill. The mechanism by which such an attack takes place is the ability of the very small media to enter the bearing construct at clearance present at the bearing interface between the bearing surface of the bearing construct and the rotating surface journaled within the bearing surface, the clearance being present at the bearing interface as a result of manufacturing tolerances, and interact with the confronting surfaces at the bearing interface to cause abrasion and consequent excessive wear, with concomitant deleterious consequences. For example, in the embodiment illustrated by basket media mill 10, the basket bearing construct includes a bearing interface 90 between the bearing surface 92 of bushing 74 and the rotating surface 94 of shaft 70 of the rotor 50.

Figure 3:
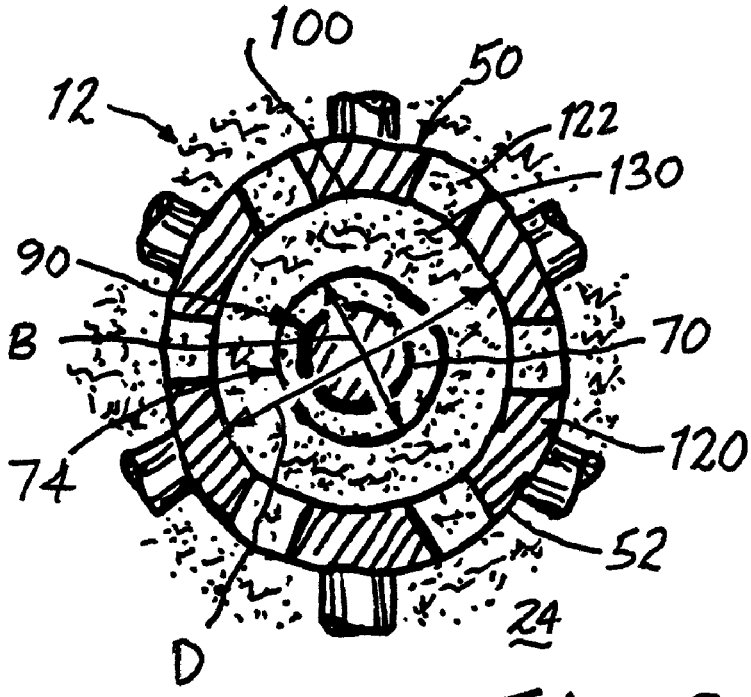
FIG. 3 is an enlarged fragmentary transverse cross-sectional view taken along line 3-3 of FIG. 1.
Figure 4:
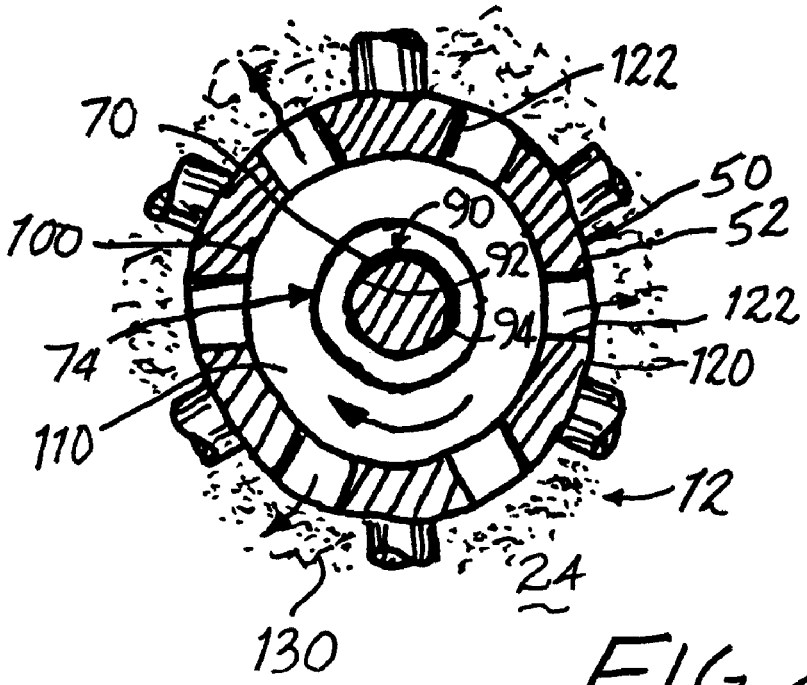
FIG. 4 is a cross-sectional view similar to FIG. 3, and showing a further stage of operation.

The present invention protects against the entry of media into the clearance at the bearing interface 90 between the bearing surface 92 of the bushing 74 and the rotating surface 94 of the shaft 70 of the rotor 50, thereby deterring excessive wear which otherwise might occur if media were allowed to enter the bearing construct at the bearing interface 90. To that end, rotor 50 is provided with a recess shown in the form of a hollow 100 juxtaposed with the bushing 74 and extending axially upwardly into hub 52 from the terminal end 72 of hub 52, which terminal end 72 is placed adjacent, in close proximity with, bushing 74. As best seen in FIGS. 2 through 4, hollow 100 preferably includes an annular cross-sectional configuration which surrounds the upper end 76 of bushing 74, the upper end 76 being located axially above the terminal end 72 of the rotor 50, and the hollow 100 having an inside diameter D greater than the outside diameter B of bushing 74 at upper end 76, and an axial length which places the upper end 76 of the bushing 74 spaced axially away, downwardly, from the upper end 110 of the hollow 100. In this manner, hollow 100 is juxtaposed with and extends in an axial direction upwardly away from the bushing 74 and in radial directions away from the bushing 74 to expose the upper end 76 of the bushing 74 to the hollow 100, with the upper end 76 essentially enveloped within the hollow 100.

Hollow 100 establishes a hub wall 120 between the diameter D of the hollow 100 and the overall diameter of the hub 52. As best seen in FIGS. 2 through 4, as well as in FIG. 1, a plurality of openings shown in the form of ports 122 are spaced circumferentially around hub wall 120 and extend radially through the hub wall 120, from the hollow 100 to the interior 24 of the basket 12. In the preferred construction, ports 122 extend in axial directions along the hub wall 120, from the terminal end 72 of hub 52 toward the upper end 110 of hollow 100, are aligned radially with the upper end 76 of busing 74, and provide open communication between the hollow 100 and the interior 24 of the basket 12. When the rotor 50 is stationary, as seen in FIG. 3, media and feedstock, illustrated diagrammatically at 130, may be present in hollow 100; however, upon rotation of rotor 50 during processing of a mixture in the basket media mill 10, forces are developed, by virtue of the placement of hollow 100 relative to bushing 74, such that media, as well as feedstock, in the vicinity of the bushing 74 will lie within the hollow 100 and will be directed out of the hollow 100 and into the interior 24 of the basket 12, through ports 122, to divert media away from bushing 74 and, in particular, away from the bearing interface 90, thereby deterring excessive wear which otherwise might occur at the bearing interface 90 if media were allowed to interact with bushing 74 during a processing operation. Likewise, feedstock, which may carry fine solid constituents, is diverted away from bushing 74 to reduce another potential source of excessive wear and early failure of the basket bearing construct.

It will be seen, then, that the present invention attains all of the objects and advantages summarized above, namely: Enables the processing of mixtures containing more finely divided solids within a basket media mill without encountering excessive wear at the basket bearing construct of the mill; renders practical the use of basket media mills in the processing of mixtures which require much finer dispersions of solids in a liquid vehicle, with the concomitant benefits of greatly reduced processing time and increased efficiency; eliminates the need for elaborate sealing structures and the like in protecting against excessive wear at the basket bearing construct of a basket media mill, especially during the processing of mixtures containing finer dispersions of solids; enables the use of much smaller media in a basket media mill for accomplishing much finer dividing and dispersion of solids into a liquid vehicle; greatly increases the effective service life of a basket media mill, and especially a mill utilized for processing mixtures containing very finely divided solids, by deterring wear at the basket bearing construct of the apparatus.

It is to be understood that the above detailed description of preferred embodiments of the invention is presented by way of example only. Various details of design, construction and procedure may be modified without departing from the true spirit and scope of the invention, as set forth in the appended claims.

The embodiments of the invention in which an exclusive property or privilege is claimed are defined as follows:

1. An improvement in a media basket mill having a basket with a basket wall establishing an interior for containing a bed of very small media within the basket, and a rotor having a hub journaled within a basket bearing construct for rotation about an axial direction within the basket while feedstock is passed through the basket, the improvement comprising:

a recess within the hub of the rotor, the recess being juxtaposed with the bearing construct and extending in the axial direction away from the bearing construct and into the hub, and in radial directions to expose the bearing construct to the recess and to establish a hub wall between the recess and the interior of the basket; and at least one at least one opening in the hub, the opening extending through the hub wall in a radial direction from the recess to the interior of the basket outside the rotor such that upon rotation of the rotor, media and feedstock in the vicinity of the bearing construct will be directed from the recess through the at least one opening to the interior of the basket and into the bed of media and feedstock outside the rotor, thereby diverting media and feedstock away from the bearing construct and deterring excessive wear which might otherwise result from media and feedstock interacting with the bearing construct during rotation of the rotor.

2. The improvement of claim 1 wherein the at least one opening comprises a port extending in the axial direction along the hub.

3. The improvement of claim 2 wherein the hub includes a terminal end in close proximity with the bearing construct, and the port extends from the terminal end in the axial direction along the hub wall.

4. The improvement of claim 1 including a plurality of openings in the hub, the openings being spaced apart circumferentially around the hub wall, each opening extending through the hub wall in a radial direction.

5. The improvement of claim 4 wherein each opening comprises a port extending in the axial direction along the hub.

6. The improvement of claim 5 wherein the hub includes a terminal end in close proximity with the bearing construct, and each port extends from the terminal end in the axial direction along the hub wall.

7. The improvement of claim 1 wherein:

the bearing construct includes a bearing;

the rotor includes a shaft extending in an axial direction along the axis of rotation, the shaft extending into the bearing along a bearing interface; and the recess comprises a generally annular hollow extending in the axial direction, circumferentially around the shaft and juxtaposed with the bearing interface.

8. The improvement of claim 7 wherein the at least one opening comprises a port extending in the axial direction along the hub.

9. The improvement of claim 8 wherein the hub includes a terminal end in close proximity with the bearing construct, and the port extends from the terminal end in the axial direction along the hub wall.

10. The improvement of claim 7 including a plurality of openings in the hub, the openings being spaced apart circumferentially around the hub wall, each opening extending through the hub wall in a radial direction.

11. The improvement of claim 10 wherein each opening comprises a port extending in the axial direction along the hub.

12. The improvement of claim 11 wherein the hub includes a terminal end in close proximity with the bearing construct, and each port extends from the terminal end in the axial direction along the hub wall.

13. A method for deterring wear at a basket bearing construct in a media basket mill having a basket with a basket wall establishing an interior for containing a bed of very small media within the basket, and a rotor having a hub journaled within the basket bearing construct for rotation about an axial direction within the basket while feedstock is passed through the basket, the method comprising:

providing a recess within the hub of the rotor;

placing the recess in juxtaposition with the bearing construct so as to extend in the axial direction away from the bearing construct and into the hub, and in radial directions to expose the bearing construct to the recess and to establish a hub wall between the recess and the interior of the basket;

providing at least one opening in the hub;

placing the at least one opening so as to extend through the hub wall in a radial direction from the recess to the interior of the basket outside the rotor; and rotating the rotor to direct media and feedstock in the vicinity of the bearing construct from the recess through the at least one opening to the interior of the basket and into the bed of media and feedstock outside the rotor, to thereby divert media and feedstock away from the bearing construct and deter excessive wear at the bearing construct which might otherwise result from media and feedstock interacting with the bearing construct during rotation of the rotor.

14. The method of claim 13 wherein the rotor includes a shaft, and the bearing construct includes a bearing which journals the rotor at a bearing interface between the bearing and the shaft, the method further including rotating the rotor to divert media and feedstock away from the bearing interface and deter excessive wear at the bearing interface which might otherwise result from media and feedstock interacting with the bearing during rotation of the rotor.

15. The method of claim 14 including providing a plurality of openings in the hub, the openings being spaced apart circumferentially around the hub wall, each opening extending through the hub wall in a radial direction, and directing media and feedstock in the vicinity of the bearing from the recess through the openings to the interior of the basket and into the bed of media and feedstock outside the rotor, to thereby divert media and feedstock away from the bearing and deter excessive wear at the bearing which might otherwise result from media and feedstock interacting with the bearing during rotation of the rotor.

16. The method of claim 13 wherein the very small media comprises media elements having a size less than 0.5 millimeter.

17. The method of claim 13 wherein the very small media comprises media elements in a size range of about 0.5 millimeter to about 0.05 millimeter.

* * * * *